US012690639B2

(12) United States Patent
Shabin

(10) Patent No.: US 12,690,639 B2
(45) Date of Patent: Jul. 28, 2026

(54) SELF-LEVELING FOOTWEAR

(71) Applicant: Marina Shabin, Sunny Isles Beach, FL (US)

(72) Inventor: Marina Shabin, Sunny Isles Beach, FL (US)

(73) Assignee: Marina Shabin, Sunny Isles Beach, FL (US)

( * ) Notice: Subject to any disclaimer, the term of this patent is extended or adjusted under 35 U.S.C. 154(b) by 201 days.

(21) Appl. No.: 18/100,503

(22) Filed: Jan. 23, 2023

(65) Prior Publication Data

US 2024/0245164 A1 Jul. 25, 2024

(51) Int. Cl.

| | |
|---|---|
| ***A43B 3/44*** | (2022.01) |
| ***A43B 3/34*** | (2022.01) |
| ***A43B 5/06*** | (2022.01) |
| ***A43B 7/38*** | (2006.01) |
| ***A43B 13/14*** | (2006.01) |
| ***A43B 13/20*** | (2006.01) |

(52) U.S. Cl.

CPC ..... *A43B 7/38* (2013.01); *A43B 3/34* (2022.01); *A43B 5/06* (2013.01); *A43B 13/14* (2013.01); *A43B 13/203* (2013.01)

(58) Field of Classification Search

CPC .... A43B 3/44; A43B 3/46; A43B 3/48; A43B 5/06; A43B 13/20; A43B 13/203

See application file for complete search history.

(56) References Cited

U.S. PATENT DOCUMENTS

| | | | | |
|---|---|---|---|---|
| 5,537,762 | A | 7/1996 | Walters | |
| 5,813,142 | A * | 9/1998 | Demon | A43B 3/44 600/592 |
| 6,231,527 | B1 | 5/2001 | Sol | |
| 8,893,403 | B2 | 11/2014 | Mohlmann | |
| 9,445,965 | B2 | 9/2016 | Mor et al. | |
| 11,305,152 | B2 | 4/2022 | Alothmany et al. | |
| 11,464,279 | B2 | 10/2022 | Alothmany et al. | |
| 11,464,286 | B2 * | 10/2022 | Jacob | G05D 16/2066 |
| 2013/0278436 | A1 * | 10/2013 | Ellis | A43B 13/20 36/43 |
| 2015/0305436 | A1 * | 10/2015 | Doyle | A43B 17/035 36/43 |

(Continued)

FOREIGN PATENT DOCUMENTS

| | | | |
|---|---|---|---|
| CN | 108338444 | A | 7/2018 |
| CN | 213939874 | U | 8/2021 |

(Continued)

*Primary Examiner* — Sharon M Prange

(57) ABSTRACT

The inventor has realized that there is a need for adaptive footwear that can respond to variations in surfaces on which persons travel or exercise. The adaptation can extend to self-leveling functions to resolve surface asymmetry. According to some aspects, footwear, and for example, athletic shoes, can be improved to adjust the height of a person's foot based on dynamic adjustments made in the sole of the footwear. According to some aspects, differences in striking height (e.g., a distance between the user's foot and the ground) between shoes can induce asymmetry in leg length resulting in medical issues. An athletic shoe can provide self-leveling functions to automatically adjusts the shoe to even out an asymmetry that is detected by embedded sensors.

16 Claims, 7 Drawing Sheets

(56) References Cited

U.S. PATENT DOCUMENTS

| | | | | |
|---|---|---|---|---|
| 2016/0174658 | A1 | 6/2016 | Desmarais | |
| 2017/0071287 | A1* | 3/2017 | Kim | A43C 15/09 |
| 2017/0135607 | A1 | 5/2017 | Morris Bamberg et al. | |
| 2017/0150785 | A1* | 6/2017 | Walker | A43B 13/20 |
| 2018/0035752 | A1* | 2/2018 | Walker | A43B 3/34 |
| 2018/0264320 | A1 | 9/2018 | Chang et al. | |
| 2019/0000183 | A1* | 1/2019 | Mou | A43B 17/035 |
| 2019/0059511 | A1* | 2/2019 | Walker | A43B 3/34 |
| 2019/0110551 | A1* | 4/2019 | Walker | G01B 7/30 |
| 2020/0375310 | A1* | 12/2020 | Weast | A43B 7/1425 |
| 2021/0145622 | A1* | 5/2021 | Riffel | A43B 17/006 |
| 2021/0308520 | A1 | 10/2021 | Alothmany et al. | |
| 2021/0353003 | A1 | 11/2021 | Tang | |
| 2023/0354952 | A1* | 11/2023 | Machanian | A43B 7/147 |
| 2025/0248475 | A1* | 8/2025 | Pape | A61B 5/01 |
| 2025/0295359 | A1* | 9/2025 | Becsek | A61B 5/6807 |
| 2026/0000153 | A1* | 1/2026 | Bhasin | A43B 3/44 |

FOREIGN PATENT DOCUMENTS

| | | | |
|---|---|---|---|
| DE | 10 2019 100852 | A1 | 7/2019 |
| EP | 0 238 586 | A1 | 9/1987 |
| EP | 0 887 029 | A2 | 12/1998 |
| WO | WO 1987/001923 | A1 | 4/1987 |
| WO | WO 2011/024162 | A1 | 3/2011 |
| WO | WO 2013/086035 | A1 | 6/2013 |
| WO | WO 2019/138116 | A1 | 7/2019 |
| WO | WO 2022/029761 | A1 | 2/2022 |

* cited by examiner

300

SELF-LEVELING FOOTWEAR

BACKGROUND

Conventional shoes are available that include pumps and valves to aid in adjusting comfort settings. Some approaches even enable users to set their own comfort levels by increasing or decreasing air pressure of cushioning elements in the shoe.

SUMMARY

The inventor has realized that adjustable comfort settings are insufficient. The inventor has realized that there is a need for adaptive footwear that can respond to external factors and provide adjustments that are more than for comfort settings. These external factors can result in health issues for any walker or runner. For example, health issues may arise when persons run or walk on uneven surfaces. Many persons may run or walk on cambered roads that include slight grades that aid in water drainage. Running or walking on cambered roads can cause one leg to reach down farther than the other leg. The result is that the leg closer to the center of the road feels impacts as if it is a longer leg than the other. In response, a person's body compensates, for example, through the way that it bends at the knee, how much the foot flattens on impact, and/or how much the leg rotates inward during a stride. The asymmetry and/or compensation effects can lead to knee or hip inflammation, and can result in asymmetric pelvic tilt and back pain. Some persons may attempt to compensate for this asymmetry by running or walking in the same direction, but on the opposite side of the road. However, this may expose persons to the dangers of invisible or inaudible car traffic, and simply does not resolve the potential effects on the body.

The inventor has realized that there is a need for adaptive footwear that can respond to variations in surfaces on which persons travel or exercise. The adaptations can extend to self-leveling functions to resolve surface asymmetry. According to some aspects, footwear, and for example, athletic shoes, can be improved to adjust the striking height of a person's foot based on dynamic adjustments made in the sole of the footwear to adjust a height of the shoe and the striking height of respective feet. According to some aspects, differences in striking height (e.g., a distance between the user's foot and the ground) between shoes can induce asymmetry in leg length and can result in asymmetrical pelvic tilt and back pain. In some embodiments, an athletic shoe is provided that automatically adjusts the shoe to even out a height asymmetry. In some embodiments, the shoe can include embedded sensors that are configured to determine any asymmetry. In further embodiments, the sole of the shoe may be equipped with chambers that can inflate or deflate to adjust the height of respective shoes to resolve any differences in strike height between feet. In another example, the chambers can inflate or deflate to adjust the tilt of a shoe. In some examples, the air chambers can be controlled using pumps and valves. In further example, a connected device can provide control signals to the valves and/or pumps triggering inflation or deflation. In still other examples, the device can be configured to monitor sensor data and dynamically adjust the chamber(s) to resolve height asymmetry (e.g., difference in height (e.g., strike height) between a first and second shoe, tilt of a given shoe, etc.).

According to one aspect, a shoe is provided. The shoe comprises a sensor configured to measure height data; at least one chamber disposed in a sole of the shoe, the at least one chamber configured to manipulate a height of the shoe; and a valve configured to control a size of the at least one chamber and resulting height of the shoe.

According to one embodiment, the shoe further comprises at least one processor configured to analyze the height data over time to identify height asymmetry between a pair of shoes. According to one embodiment, the at least one processor is further configured to trigger operation of the valve to adjust the height of the shoe to reduce any identified asymmetry during movement. According to one embodiment, the shoe further comprises a pump disposed in the sole of the shoe and wherein the at least one processor is configured to trigger operation of the valve or the pump. According to one embodiment, the shoe further comprises a valve controller communicatively coupled to the at least one processor, wherein the valve controller is configured to open and close the valve responsive to control signals from the at least one processor. According to one embodiment, the at least one processor is configured to trigger height adjustment to the shoe, responsive to determining that a threshold height asymmetry has been exceeded.

According to one embodiment, the sensor is configured to capture data for a first ground height, and wherein the at least one processor is configured to determine a difference between the first ground height of the shoe and a second ground height of a second shoe.

According to one embodiment, the height of the shoe is based at least in part on a dynamic thickness of the sole of the shoe. According to one embodiment, the shoe comprises a communication component, the communication component is configured to manage communication between the shoe, a mobile device, and the at least one processor. According to one embodiment, the mobile device is configured to display a user interface, wherein the user interface is configured to accept user input to define a height asymmetry threshold for self-leveling operation.

According to one embodiment, the height asymmetry threshold includes at least one of a number of consecutive uneven steps required before the height of the shoe can be adjusted, a threshold time period of consecutive uneven steps required, or a minimum threshold height asymmetry over a period of time or distance. According to one embodiment, the at least one chamber comprises of a first chamber and a second chamber, and the first chamber is configured to be responsive to adjustments independently of the second chamber. According to one embodiment, the at least one chamber comprises lateral sections, the sensor is a tilt sensor, and at least one section of the lateral sections is inflated to reduce a tilt detected by the tilt sensor. According to one embodiment, the shoe further comprises a location sensor.

According to one embodiment, the shoe further comprises at least one processor configured to analyze location data and record height adjustments to the shoe for respective location data. According to one embodiment, the at least one processor is configured to: match the location data to a stored location and recorded height adjustments; and replay the recorded height adjustments.

According to one aspect, a computer implemented method for adjusting a height of a shoe is provided. The method comprises collecting, by at least one processor, sensor data, the sensor data including height data; analyzing, by the at least one processor, the sensor data to identify a height asymmetry; determining, by the at least one processor, that the height asymmetry meets a threshold; and adjusting, by the at least one processor the height of the shoe to reduce the height asymmetry. According to one embodiment, adjusting the height of the shoe includes triggering, by the at least one processor, operation of a valve or pump to inflate or deflate a chamber disposed in a sole of the shoe.

According to one embodiment, adjusting the height of the shoe includes triggering, by the at least one processor, a height adjustment to the shoe, responsive to determining that a threshold height asymmetry has been exceeded. According to one embodiment, the method further comprises matching, by the at least one processor, location data to a stored location and recorded height adjustments; and replaying, by the at least one processor, the recorded height adjustments. According to one embodiment, the method further comprises analyzing height asymmetry and modifying the recorded height adjustments based on any detected changes in height asymmetry. In further embodiments, a pair of shoes are provided that include the structures and/or perform the functions of the preceding embodiments.

Still other aspects, embodiments, and advantages of these exemplary aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. Any embodiment disclosed herein may be combined with any other embodiment in any manner consistent with at least one of the objectives, aims, and needs disclosed herein, and references to "an embodiment." "some embodiments." "an alternate embodiment," "various embodiments." "one embodiment" or the like are not necessarily mutually exclusive and are intended to indicate that a particular feature, structure, or characteristic described in connection with the embodiment may be included in at least one embodiment. The appearances of such terms herein are not necessarily all referring to the same embodiment. Various aspects, embodiments, and implementations discussed herein may include means for performing any of the recited features or functions.

BRIEF DESCRIPTION OF THE FIGURES

Various aspects of at least one example are discussed below with reference to the accompanying figures, which are not intended to be drawn to scale. The figures are included to provide an illustration and a further understanding of the various aspects and examples, and are incorporated in and constitute a part of this specification, but are not intended as a definition of the limits of a particular example. The drawings, together with the remainder of the specification, serve to explain principles and operations of the described and claimed aspects and examples. In the figures, each identical or nearly identical component that is illustrated in various figures is represented by a like numeral. For purposes of clarity, not every component may be labeled in every figure. In the figures:

DETAILED DESCRIPTION

According to some aspects, an improved shoe is provided. The shoe is configured to adjust the height or tilt of the shoe based on inflation or deflation of chambers disposed in the shoe sole. Various embodiments use one or more chambers disposed in the sole of the shoe that are configured to inflate or deflate. Inflation or deflation can be based on an asymmetry in height and/or tilt measured by a sensor in the shoe. Further embodiments allow the shoe to be in communication with a device and/or processor that is configured to monitor sensor data, identify asymmetry, and automatically adjust respective chamber(s) to resolve. Further embodiments are configured to record information on adjustments made and associate those adjustments to specific routes and/or locations. In some examples, the device and/or processor can be configured to predictively adjust the chamber based on an identified route and/or location.

Examples of the methods, devices, and systems discussed herein are not limited in application to the details of construction and the arrangement of components set forth in the following description or illustrated in the accompanying drawings. The methods and systems are capable of implementation in other embodiments and of being practiced or of being carried out in various ways. Examples of specific implementations are provided herein for illustrative purposes only and are not intended to be limiting. In particular, acts, components, elements, and features discussed in connection with any one or more examples are not intended to be excluded from a similar role in any other examples.

Figure 1:
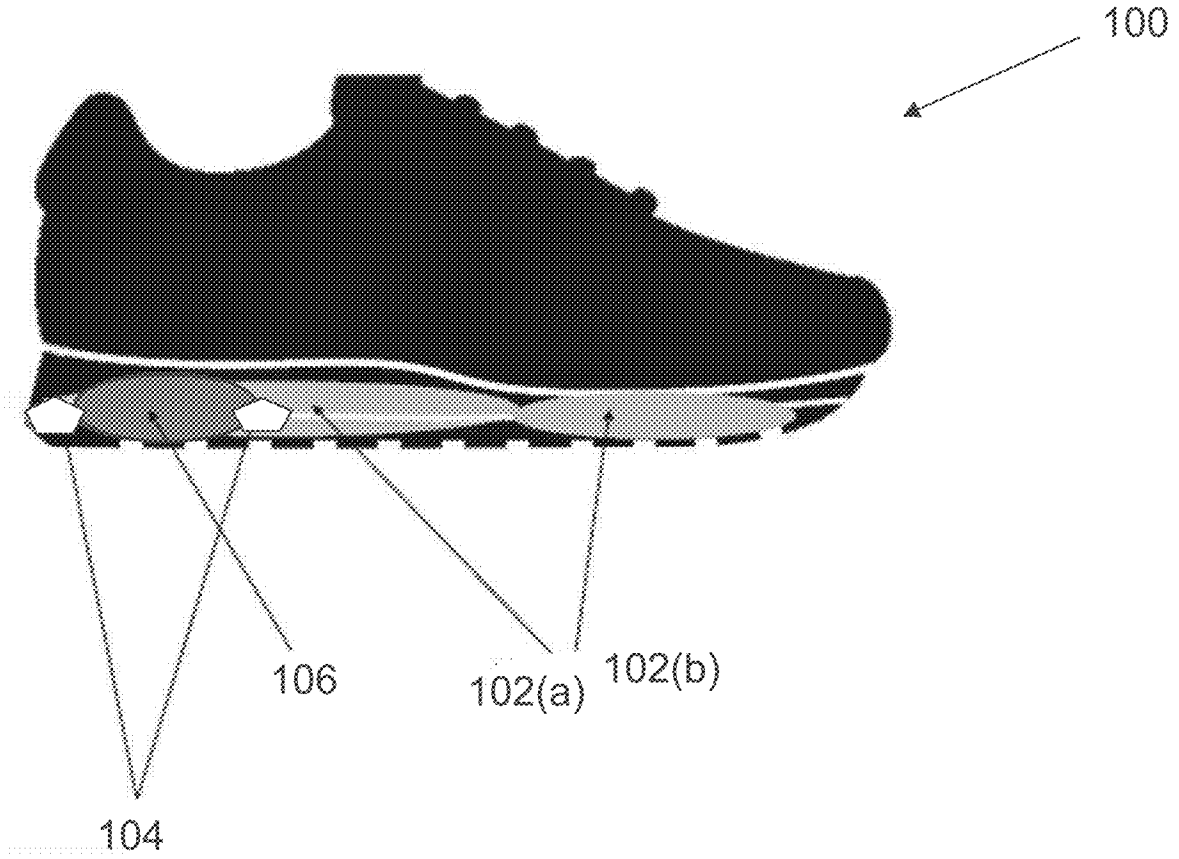
FIG. 1 is a side view of an example shoe, according to one embodiment.

FIG. 1 illustrates an example embodiment of a shoe 100 configured to adjust the height and/or tilt of the shoe 100. The shoe 100 can include a variety of components that each execute respective function and/or perform operations to adjust the height and/or tilt of the shoe. According to one embodiment, the shoe 100 includes one or more chambers 102 disposed in the sole of the shoe. The chambers 102 can be configured to inflate or deflate to adjust the height and/or tilt of the shoe 100. The chambers 102 may be configured to hold gases or fluids. According to an embodiment, the chambers 102 may include chambers 102(*a*) and 102(*b*). Chamber 102(*a*) can be adjusted independently of chamber 102(*b*). In some examples, the chambers 102 are connected to a pump 106 through valves 104 to inflate or deflate the chambers 102.

According to one embodiment, the chambers 102 can be connected to one or more valves 104. When opened, the valves 104 may allow flow into or out of the chambers 102 to inflate or deflate the chambers 102, respectively. When closed, the valves may reduce or stop the flow in or out of the chambers 102. The valves 104 may be electrically controlled valves or mechanically controlled valves. The electrically controlled valves may be connected to a power source. According to another embodiment, the valves 104 may be connected to a valve controller. The valve controller can be configured to open and close the valve. In some embodiments, the valves are operated based on a control signal from the valve controller.

According to one embodiment, the shoe 100 can include a pump 106 configured to create flow into or out of the chamber to inflate or deflate the chambers 102, respectively. In some examples the pump 106 can force air or liquid into or out of the chambers 102. In another example, the pump 106 can be disposed in the sole of the shoe 100. In a further example, the pump 106 can be connected to the chambers 102 through the valves 104. According to one embodiment, the pump 106 can be an electric pump. The electric pump may be powered by a power supply. In an alternative embodiment, the pump 106 can be a mechanical pump. The mechanical pump can be configured to use impact forces on the shoe to capture pressure or energy. The pressure and/or energy can then be used to trigger changes to the chamber(s). In one example, the mechanical pump forces air in or out of the chamber using the weight of a person.

While not shown, some embodiments can include various sensors to help determine whether the chambers 102 should be adjusted. According to one embodiment, the shoe 100 can include one or more sensors that measure height data. In some examples, height data can be used to detect asymmetries of the shoe or between a first shoe and a second shoe. In some embodiments, height data can be determined based on the shoe height relative to the ground, the difference in height between a first shoe and a second shoe, and/or the tilt of a shoe. In some embodiments, the sensors can include displacement sensors, tilt sensors, accelerometers, drop sensors, vibration sensors, and/or other known sensors to measure height data. In some embodiments, differences in position/height between two shoes can be determined based on signal strength of wireless communication devices embedded in the shoes. In further example, wireless signal information can be analyzed to determine shoe height and any asymmetry.

According to some embodiments, the sensors may be disposed throughout the shoe. In some examples, the sensors can be disposed in the sole of the shoe. In further embodiments, the shoe can be configured transmit sensor data to a processor, for example, via a Bluetooth connection or other wireless communication. The processor can be configured to analyze the received sensor data and send control signals to inflate or deflate the chambers 102.

According to other embodiments, the shoe 100 can include one or more location sensors to generate the location data of the shoe. In some examples, the location sensors may be disposed throughout the shoe. In some examples, the sensors can be disposed in the sole of the shoe. In another example, the location sensors may be disposed in a device. The location sensor can transmit location data to a device and/or processor. The device and/or processor can be configured to analyze the received location data to determine whether the location data matches a stored route and/or location. If the location data matches a stored route and/or location, then the processor can predictively adjust the chambers 102 based on the stored route and/or location.

Figure 2:
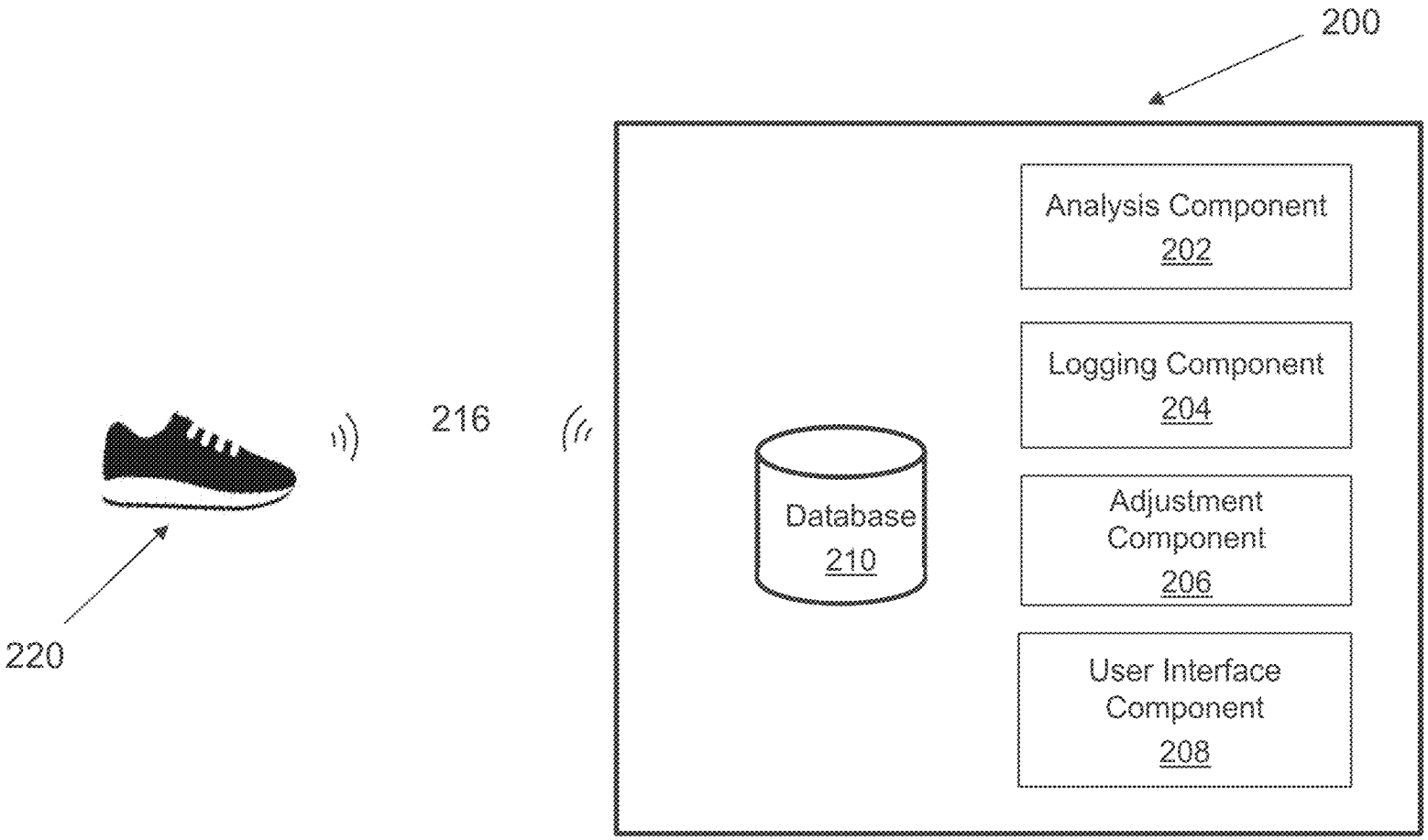
FIG. 2 is block diagram of an example system, according to one embodiment.

FIG. 2 shows an example shoe 220 that can be in communication and/or part of the system 200. According to one embodiment, the shoe 220 and the a plurality of components of system 200 can wirelessly communicate 216 to each other. The wireless communication 216 can be enabled using Bluetooth, radio frequencies, and/or other known wireless communication methods. According to another embodiment, the shoe 220 and the components can also communicate via a physical and/or wired connection. According to one embodiment, the system 200 can communicate sensor data and/or chamber adjustment information to any of the elements shown.

According to one embodiment, the system 200 can include a plurality of components configured to perform specific operations for the system 200. In other embodiments, the system 200 can perform the functions without instantiating the various components. According to one embodiment, the system 200 includes at least one processor that is configured to instantiate the various components and/or perform the functions disclosed. According to some embodiments, the system 200 can include a device and/or a processor. In some examples, the device can be a phone, smart watch, or laptop. In other examples, the device and/or processer can be integrated into the shoe and/or distributed between a pair of shoes.

According to one embodiment, the system 200 can include an analysis component 202. In one example, the analysis component 202 can determine a height for a given shoe. The analysis component can also determine any height asymmetry (e.g., differences in height (e.g., strike height) between a first and second shoe, tilt of a given shoe) during use. In a further embodiment, the analysis component can analyze location data and match the location data to a stored route and/or location to predictively adjust the shoe.

According to one embodiment, the system 200 can include a logging component 204. The logging component 204 may store route and/or location data, height data (which can be associated with the route and/or location data), and chamber adjustments (e.g., associated with the route and/or location data). According to one embodiment, the analysis component 202 may analyze the location data to determine whether the location data matches a stored route and/or location in the logging component 204 or stored adjustment information for a matching location. If the location data matches the stored route and/or location in the logging component 204, then the chamber can be predictively adjusted using the stored chamber adjustments associated with the identified route and/or location. In a further embodiment, if the location data matches the stored route and/or location in the logging component 204, then present height data can be matched to stored height data associated with the stored route and/or location. This may aid improve the predictive adjustment function of the shoe, since chamber adjustment is based upon two factors. In some embodiments, the system 200 can be configured to replay a set of chamber adjustments recorded for a prior or location. In further embodiments, the system can make dynamic adjustments to any replay setting as height information is captured and analyzed.

According to one embodiment, the system 200 can include an adjustment component 206. The adjustment component may transmit commands to the valve and/or pump to adjust the chamber. According to one embodiment the system 200 can include a user interface component 208. The user interface component 208 can allow the user to adjust the shoe based on the user's preferences. In some embodiments, the user can set preferences by which the system can manage dynamic adjustments to shoe height. In one example, the user interface component 208 can allow the user to determine a threshold number of consecutive uneven steps required before the shoe can inflate or deflate to compensate for height asymmetry. For instance, if the threshold number of consecutive uneven steps is set to 10, then the shoe is configured to inflate or deflate after at least 10 consecutive uneven steps are detected. In other embodiments, the system includes a default threshold for height asymmetry and a time period. For example, if a height asymmetry is detected for over five seconds, the system is configured to adjust the height of respective shoes to resolve. In still other embodiments, the system can include a height difference threshold that must be exceeded to trigger self-leveling functionality. In one example, the height difference threshold can be a measure of height asymmetry that in aggregate exceeds 10 cm. In other examples, the height threshold may be an asymmetry over a period of time or distance. Additional settings can include single measurements exceeding a threshold, among other options.

In some embodiments, the user interface enables a user to define or update the threshold settings for self-leveling functionality. In another example, the user interface component 208 can allow the user to disable the automatic adjustment function of a shoe. Some examples of instances when the user may disable the automatic adjustment function of the shoe include walking, running on a cantered road, or running on off-road surfaces.

Figure 3:
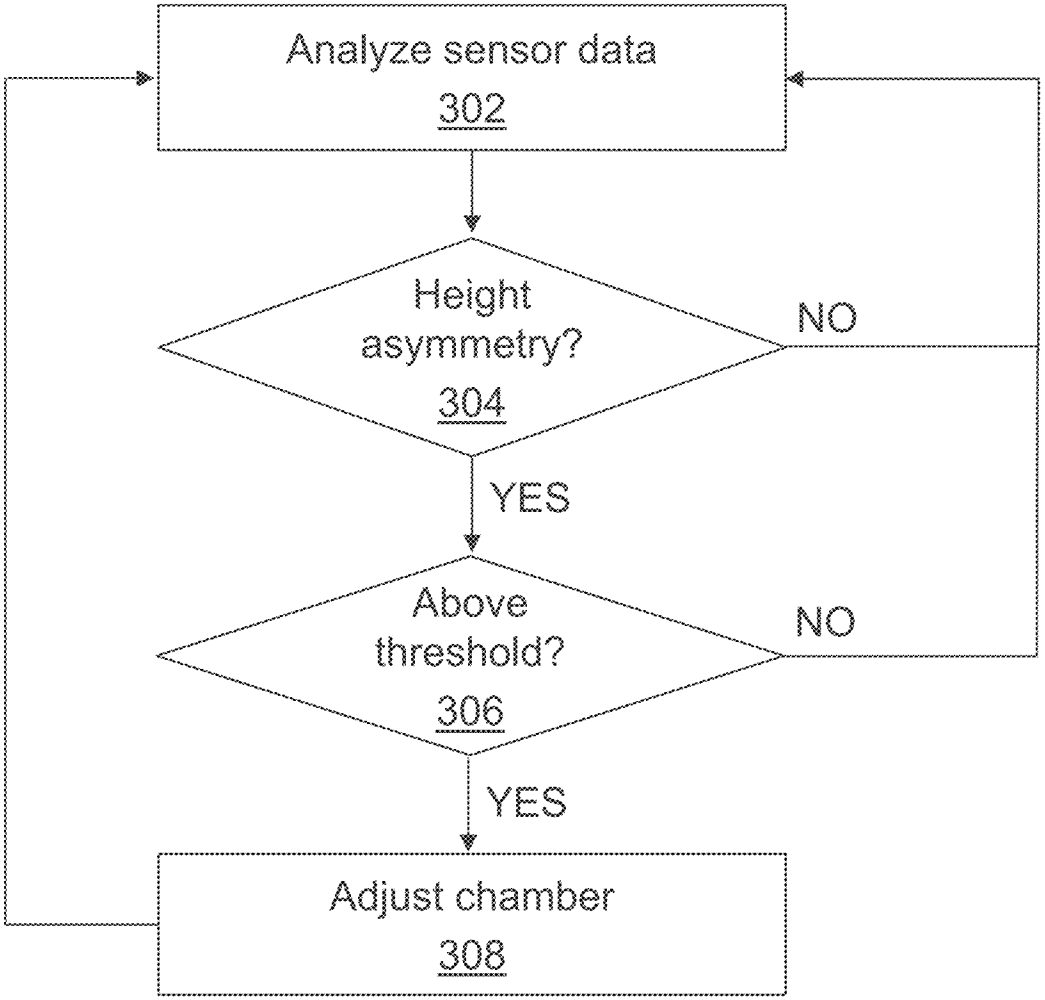
FIG. 3 is an example process flow to determine whether to inflate or deflate the chamber, according to one embodiment.

FIG. 3 illustrates an example process flow to determine whether to adjust the chambers. Process 300 can begin with analyzing sensor data at 302. At 302, the sensor data can be analyzed to determine a height (e.g., strike height) for a given shoe, the difference in height between a first shoe and a second shoe, or a tilt for a given shoe.

According to one embodiment, process 300 can begin at 304 with determining if a height asymmetry (e.g., difference in height (e.g., strike height) between a first and second shoe, tilt of a given shoe) is present in the analyzed sensor data 302. If a height asymmetry is present 304 YES, then the process 300 continues to 306. At 306, the system compares the height asymmetry to a threshold value. If the height asymmetry is above the threshold value 306 YES, then the chambers will be adjusted 308 to decrease the height asymmetry. As discussed above, various threshold can be used. For example, a maximum detected differential, a maximum aggregate differential over time and/or distance, a maximum height differential over a number of steps, among other options. In other examples, instead of a maximum value that is exceeded to trigger self-leveling functionality, a minimum value must be met in order to trigger self-leveling functions.

According to one embodiment, at 304, if no height asymmetry is present 304 NO, then the process continues to analyze sensor data at 302. Similarly, at 306, if the height asymmetry is not above the threshold value 306 NO, then the process continues to analyze sensor data at 302.

In some embodiments, as asymmetry is detected and/or adjustments made to the chambers, the sensor data can be recorded. In some examples, the data can be recorded as part of a route. A shoe wearer can even indicate the start of a specific route, for example, via a user interface to explicitly establish an exercise route on which to record and associate sensor data. Various readings can be captured for the route and specific locations within the route. Further adjustments made to correct asymmetry can also be captured, and may be captured with location specific information. Capture of sensor data and/or chamber adjustments with location information facilitates re-use or replay of those adjustments for respective routes and/or respective locations.

Figure 4A:
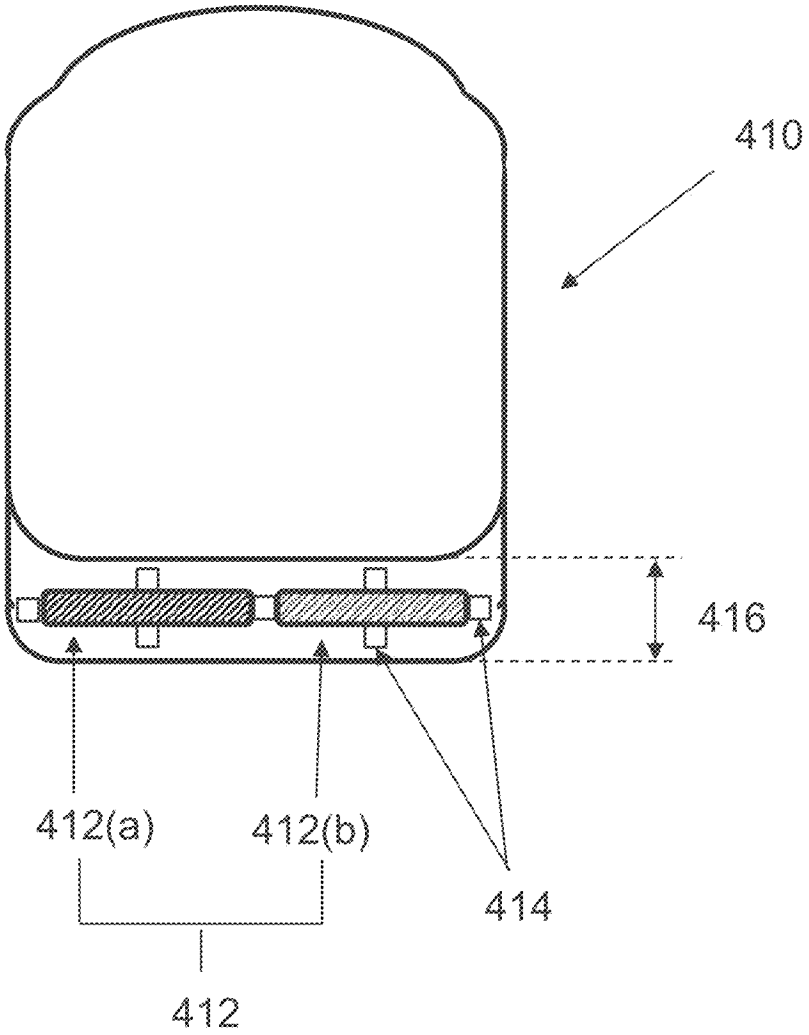
FIG. 4A is a rear view of an example shoe having a chamber with lateral sections, according to one embodiment.

FIG. 4A shows a rear view of an example shoe having a chamber 412 with lateral sections 412(*a*) and 412(*b*). The lateral sections 412(*a*) and 412(*b*) can be disposed in the sole of the shoe. The lateral sections 412(*a*) and 412(*b*) can be adjusted to change the height 416 of the shoe, which is used to reduce detected height asymmetry in the shoe or between a first and second shoe. In some embodiments, the height 416 can be the width of the shoe's sole. According to one embodiment, the lateral sections 412(*a*) and 412(*b*) may be adjusted to decrease the difference in height (e.g., striking height) between a first and second shoe. According to a further embodiment, at least one of the lateral sections 412(*a*) and 412(*b*) can be adjusted to decrease a detected tilt of the shoe. The tilt may be a side to side tilt of the shoe.

According to one embodiment, the one or more valves 414 can be configured to adjust the sections 412(*a*) and 412(*b*) to increase or decrease a height of the shoe. When opened, the valves 414 may allow flow into or out of the chamber 412 to inflate or deflate the chambers 412, respectively. When closed, the valves 414 may reduce or stop the flow in or out of the chamber 412. The valves 414 can be disposed in the sole of the shoe. According to one embodiment, the valves 414 can be disposed at any of the illustrated positions in FIG. 4A but are not limited to being disposed at the illustrated positions.

According to one embodiment, the chamber 412 can comprise of at least two lateral sections 412(*a*) and 412(*b*). Each section 412(*a*) and 412(*b*) may be independently adjusted. Each section 412(*a*) and 412(*b*) may have its own corresponding valve 414 to be independently adjusted. In further embodiments, a pump can be connected to the valves 414 and used to provide positive pressure to inflate the sections 412(*a*) and 412(*b*) through the values 414, or provide negative pressure to deflate the sections 412(*a*) and 412(*b*) through the values 414. In some embodiments, control signal to operate the pump can trigger inflation or deflation of respective sections. In still other embodiments, control signal can be communicated to the valves 414 to provide for the same operation. In yet other, one or more control signals can be communicated to pump and valves 414 or any combination thereof.

Figure 4B:
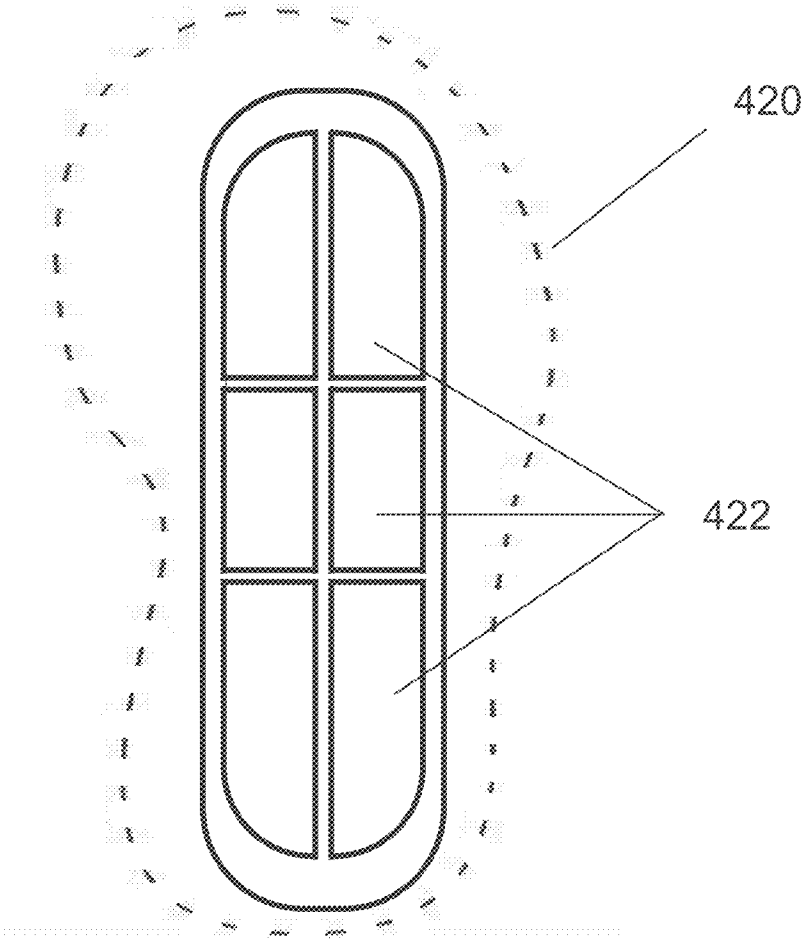
FIG. 4B is a cross-sectional view of an example shoe having a chamber with six sections, according to one embodiment.

FIG. 4B shows a cross-sectional view of the shoe with a chamber. According to one embodiment, the chamber can include six chambers 422 disposed in the sole. Each section may be independently adjusted. The sections 422 can be adjusted to reduce height asymmetry of the shoe or between a first and second shoe. According to one embodiment, the sections 422 may be adjusted to decrease the difference in striking height between a first and second shoe. According to a further embodiment, at least one of the sections can be adjusted to decrease the tilt of the shoe. Additional sections(s) and/or chamber(s) may be included to decrease the tilt of the shoe in various directions (including, but not limited to, side to side, front to back, and/or a combination of side to side and front to back tilt).

Figure 5:
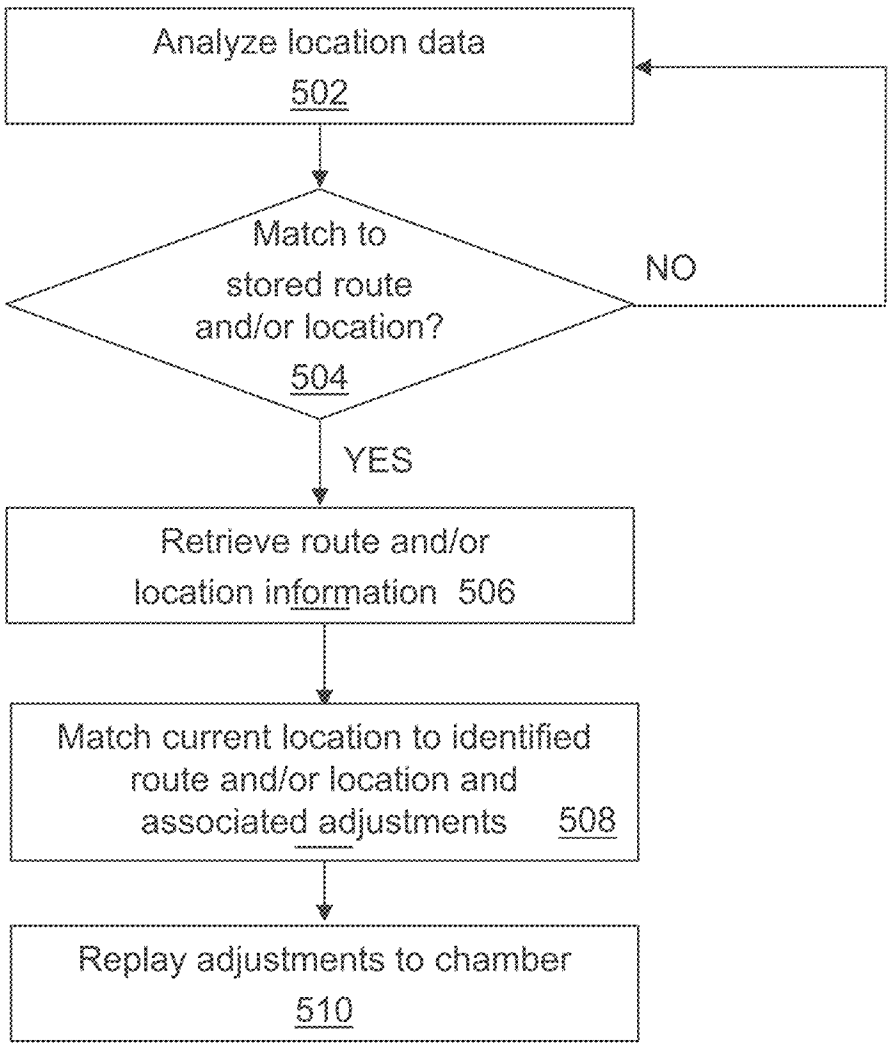
FIG. 5 is an example process flow using route and/or location information to adjust the chamber, according to one embodiment.

FIG. 5 illustrates an example process flow using location information to predictively adjust the chambers. According to one embodiment, process 500 can begin with analyzing location data. According to one embodiment, process 500 continues at 504 to determine if the analyzed location data matches a stored route and/or location. If the analyzed location data matches a stored route and/or location 504 YES, then the process 500 continues to 506. At 506, data for the matched route and/or location is retrieved including prior adjustments made to respective chamber(s), for example, during a walk or run. The process 500 then continues to 508 which matches a current location or position to a stored location and position having associated adjustment information (e.g., deflate right shoe chamber, inflate right show chamber, deflate left show chamber, inflate left show chamber, etc.). Once the associated adjustment information is retrieved process 500 continues at 510 which replays the stored adjustments to the chamber based on the current location. Not shown in process 500, additional monitoring can be executed to ensure that the replayed adjustments are sufficiently compensating for any asymmetry. In various embodiments, historic adjustments can be modified (e.g. during a walk or run, etc.) to increase or decrease adjustments in the chambers and resolve any currently detected asymmetry.

According to one embodiment, at 504, if there is no match to a stored route and/or location 504 NO, then the process 500 will continue to analyze location data 502.

Figure 6:
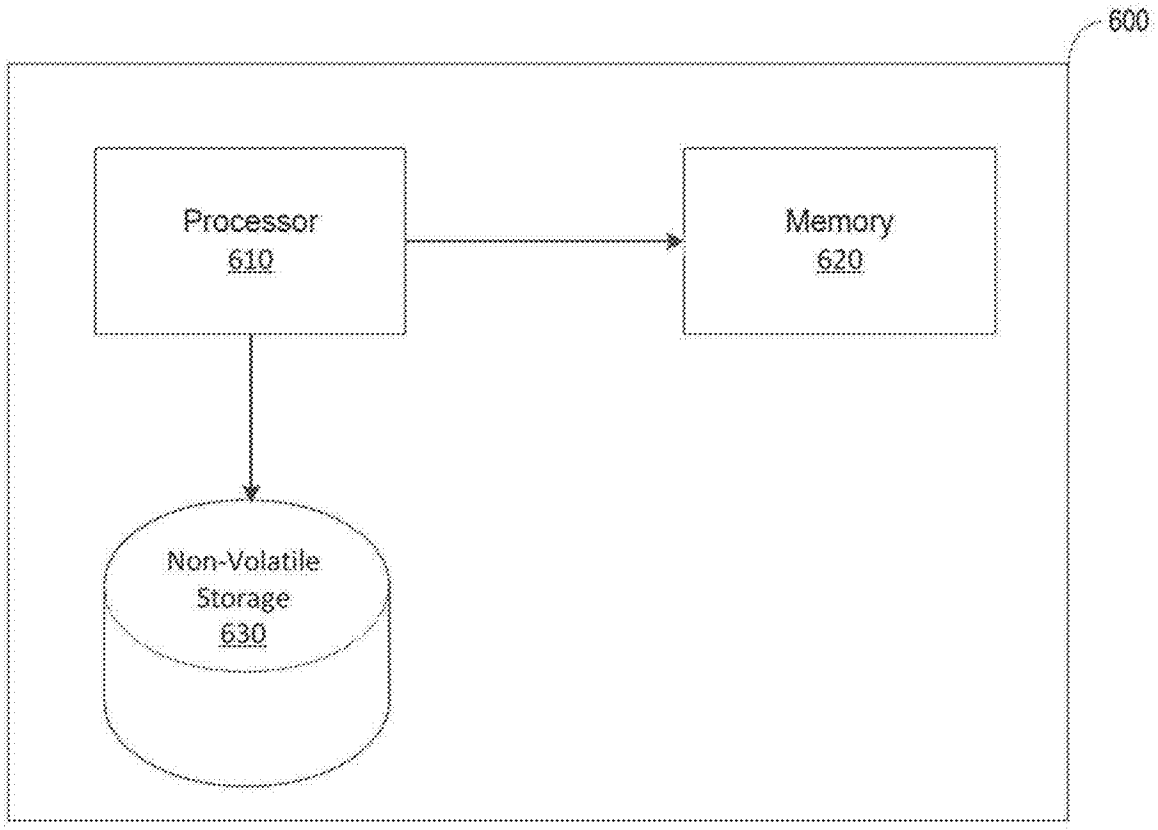
FIG. 6 is a block diagram of an example computer system improved by implementation of the functions, operations, and/or architectures described herein.

FIG. 6 is a block diagram of an example computer system that is improved by implementing the functions, operations, and/or architectures described herein. Modifications and variations of the discussed embodiments will be apparent to those of ordinary skill in the art and all such modifications and variations are included within the scope of the appended claims. Additionally, an illustrative implementation of a computer system 600 that may be used in connection with any of the embodiments of the disclosure provided herein is shown in FIG. 6. The computer system 600 may include one or more processors 610 and one or more articles of manufacture that comprise non-transitory computer-readable storage media (e.g., memory 620 and one or more non-volatile storage media 630). The processor 610 may control writing data to and reading data from the memory 620 and the non-volatile storage device 630 in any suitable manner. To perform any of the functionality described herein (e.g., image reconstruction, anomaly detection, etc.), the processor 610 may execute one or more processor-executable instructions stored in one or more non-transitory computer-readable storage media (e.g., the memory 620), which may serve as non-transitory computer-readable storage media storing processor-executable instructions for execution by the processor 610.

The terms "program" or "software" are used herein in a generic sense to refer to any type of computer code or set of processor-executable instructions that can be employed to program a computer or other processor to implement various aspects of embodiments as discussed above. Additionally, it should be appreciated that according to one aspect, one or more computer programs that when executed perform methods of the disclosure provided herein need not reside on a single computer or processor, but may be distributed in a modular fashion among different computers or processors to implement various aspects of the disclosure provided herein.

Processor-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments.

Also, data structures may be stored in one or more non-transitory computer-readable storage media in any suitable form. For simplicity of illustration, data structures may be shown to have fields that are related through location in the data structure. Such relationships may likewise be achieved by assigning storage for the fields with locations in a non-transitory computer-readable medium that convey relationship between the fields. However, any suitable mechanism may be used to establish relationships among information in fields of a data structure, including through the use of pointers, tags or other mechanisms that establish relationships among data elements.

Also, various inventive concepts may be embodied as one or more processes, of which examples (e.g., the processes described herein) have been provided. The acts performed as part of each process may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, and/or ordinary meanings of the defined terms. As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B." or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B," when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

Use of ordinal terms such as "first," "second," "third," etc., in the claims to modify a claim element does not by itself connote any priority, precedence, or order of one claim element over another or the temporal order in which acts of a method are performed. Such terms are used merely as labels to distinguish one claim element having a certain name from another element having a same name (but for use of the ordinal term).

The phraseology and terminology used herein is for the purpose of description and should not be regarded as limiting. The use of "including," "comprising," "having," "containing," "involving", and variations thereof, is meant to encompass the items listed thereafter and additional items.

Having described several embodiments of the techniques described herein in detail, various modifications, and improvements will readily occur to those skilled in the art. Such modifications and improvements are intended to be within the spirit and scope of the disclosure. Accordingly, the foregoing description is by way of example only, and is not intended as limiting. The techniques are limited only as defined by the following claims and the equivalents thereto.

The invention claimed is:

1. A pair of shoes, comprising at least one sensor configured to measure height data; at least one chamber disposed in a sole of a first shoe, the at least one chamber configured to manipulate a height of the first shoe; a valve configured to control a size of the at least one chamber and resulting height of the shoe; and at least one processor configured to access height data captured for the first shoe; access height data captured for a second shoe; and analyze the height data for the first and the second shoe over time to identify height asymmetry between the pair of shoes, the height asymmetry reflecting a difference induced by motion over an uneven surface.

2. The shoes of claim 1, wherein the height asymmetry is associated with a difference in leg length induced by motion over the uneven surface, and wherein the at least one processor is configured to reduce the asymmetry via inflation or deflation of the at least one chamber.

3. The shoes of claim 2, wherein the at least one processor is further configured to trigger operation of the valve of the first or the second shoe to reduce any identified asymmetry during movement.

4. The shoes of claim 1, further comprising a pump disposed in the sole of the first or the second shoe and wherein the at least one processor is configured to trigger operation of the valve or the pump.

5. The shoes of claim 1, further comprising a valve controller communicatively coupled to the at least one processor, wherein the valve controller is configured to open and close the valve responsive to control signals from the at least one processor.

6. The shoes of claim 1, wherein the at least one processor is configured to trigger height adjustment to the first or the second shoe, responsive to determining that a threshold height asymmetry has been exceeded.

7. The shoes of claim 1, wherein the sensor is configured to capture data for a first height associated with the first shoe at impact on the uneven surface associated with a leg length, and wherein the at least one processor is configured to determine a difference between the first height of the first shoe and a second height of a second shoe associated with the second shoe at impact on the uneven surface associated with a respective leg length.

8. The shoes of claim 1, wherein the height of the shoe is based at least in part on a dynamic thickness of the sole of the shoe.

9. The shoes of claim 1, further comprising a communication component, the communication component configured to manage communication between the shoe and a mobile device or the at least one processor.

10. The shoes of claim 9, wherein the mobile device is configured to display a user interface, wherein the user interface is configured to accept user input to define a height asymmetry threshold for self-leveling operation.

11. The shoes of claim 10, wherein the height asymmetry threshold includes at least one of a number of consecutive uneven steps required before the height of the shoe can be adjusted, a threshold time period of consecutive uneven steps required, or a minimum threshold height asymmetry over a period of time or distance.

12. The shoes of claim 1, wherein the at least one chamber comprises a first chamber and a second chamber, and the first chamber is configured to be responsive to adjustments independently of the second chamber.

13. The shoes of claim 1, wherein the at least one chamber comprises lateral sections, the sensor is a tilt sensor, and at least one section of the lateral sections is inflated to reduce a tilt detected by the tilt sensor.

14. The shoes of claim 1, further comprising a location sensor.

15. The shoes of claim 1, wherein the at least one processor is configured to analyze location data and record height adjustments to the shoe for respective location data.

16. The shoes of claim 15, wherein the at least one processor is configured to match the location data to a stored location and recorded height adjustments; and replay the recorded height adjustments.

* * * * *